US005377873A

United States Patent [19]

Minnette

[11] Patent Number: 5,377,873

[45] Date of Patent: Jan. 3, 1995

[54] DISPENSING CLOSURE

[75] Inventor: Jeffrey C. Minnette, Evansville, Ind.

[73] Assignee: Sunbeam Plastics Corporation, Evansville, Ind.

[21] Appl. No.: 225,255

[22] Filed: Apr. 8, 1994

[51] Int. Cl.[6] ..... B67D 5/22

[52] U.S. Cl. ..... 222/48; 222/39; 222/521

[58] Field of Search ..... 222/23, 39, 41, 43, 222/46, 47, 48, 49, 153, 521

[56] References Cited

U.S. PATENT DOCUMENTS

| | | | |
|---|---|---|---|
| 2,642,208 | 6/1953 | Kissling . | |
| 2,759,643 | 8/1956 | Dahlin . | |
| 3,010,619 | 11/1961 | Gronemeyer et al. . | |
| 3,033,428 | 5/1962 | Baarn . | |
| 3,578,223 | 5/1971 | Armour . | |
| 3,598,285 | 8/1971 | Stull | 222/48 |
| 4,867,354 | 9/1989 | Schreiber | 222/521 |
| 5,111,967 | 5/1992 | Schreiber | 222/39 |
| 5,199,605 | 4/1993 | Schneider | 222/48 X |
| 5,284,273 | 2/1994 | Schreiber | 222/48 X |

FOREIGN PATENT DOCUMENTS 1399492 1/1972 United Kingdom .

OTHER PUBLICATIONS

Bulletin G-90 entitled "Cable Cylinders from Greenco" published by Greenco Corporation of Tampa, Fla., copyright 1991; p. 18.

*Primary Examiner*—Gregory L. Huson
*Attorney, Agent, or Firm*—Gifford, Groh, Sprinkler, Patmore and Anderson

[57] ABSTRACT

A twist-to-open dispensing closure has a cap which threads directly onto the container neck. A bead at the bottom of the cap skirt snaps over a flange on the container neck for primary retention of the cap on the container neck. An upwardly projecting lug on the cap bead cooperates with a pair of axially extending walls on the container flange to give the user, while unthreading the cap, a sense of approaching the open, dispensing position of the closure and the cap locks in this dispensing position against further rotation, preventing accidental removal of the cap by snapping the cap bead over the container neck flange.

6 Claims, 2 Drawing Sheets

DISPENSING CLOSURE

BACKGROUND OF THE INVENTION

1. Field of the Invention

This invention relates to a dispensing closure and a dispensing closure-container package. More particularly, this invention relates to a twist-to-open type of dispensing closure and dispensing closure-container package.

2. State of the Art

There is a wide variety of twist-to-open types of closures available, most of which employ a base member which is threaded onto or snapped over the container neck and a cap member which threads onto the base member to provide axial movement of the cap for opening and closing. Such closures normally have an excessive height and require complex molds.

In other twist-to-open closures, the closure cap is threaded onto the container neck, and a fitment is used to provide closing and opening of the dispensing orifice. Quite often, the cap is completely unthreaded from the container neck in the opening process, and the user has no means for recognizing the open, dispensing position of the closure before such complete removal occurs.

SUMMARY OF THE INVENTION

The closure and closure-container package of the invention is used in conjunction with a container having a cylindrical neck with an external thread and an outward extending flange below the thread. The closure includes a fitment having a centrally located cylindrical plug member and a concentric outer skirt which seals with the container neck. The cap has a top with a centrally located dispensing orifice and a cylindrical outer skirt with an internal thread which engages the external neck thread allowing axial movement of the cap along the neck, engaging the plug member with the dispensing orifice in a closed position and disengaging the dispensing orifice in the open dispensing position. The cylindrical outer skirt of the cap has an inwardly directed bead below the internal thread which snaps over the outward extending flange on the container neck when the cap is initially applied to the container neck.

The improvement provided by the invention provides sensing of the approach of the open dispensing position when the cap is being opened and for locking the cap in that position so that the cap will not be removed from the container neck. A pair of circumferentially spaced axially extending walls are located on the container neck flange, and a lug extends axially upward from the inwardly directed cap skirt. As the cap is being turned in an opening direction, the lug will pass over a first one of the pair of walls allowing the user to sense the approach of the open position, and, as the cap is turned further, the lug will abut against the second one of the pair of walls to stop any further rotation of the cap.

In one embodiment, the axially extending walls include circumferentially spaced projections extending axially downward from the container neck flange so that as the cap is turned in the opening direction, the lug will jump over of the first projection allowing the user to sense the approach of the open position, and upon further turning, the lug will abut against the second projection, stopping the cap. Preferably the first lug is rounded to facilitate movement of the lug over the projection in both the opening and closing direction.

In another embodiment, the container neck flange is discontinuous creating the adjacent circumferentially spaced axially extending walls at adjacent ends of the flange.

BRIEF DESCRIPTION OF THE DRAWING

The advantages of the present invention will be more apparent from the following detailed description when considered in connection with the accompanying drawing wherein.

DETAILED DESCRIPTION OF THE PREFERRED EMBODIMENTS

Figure 1:
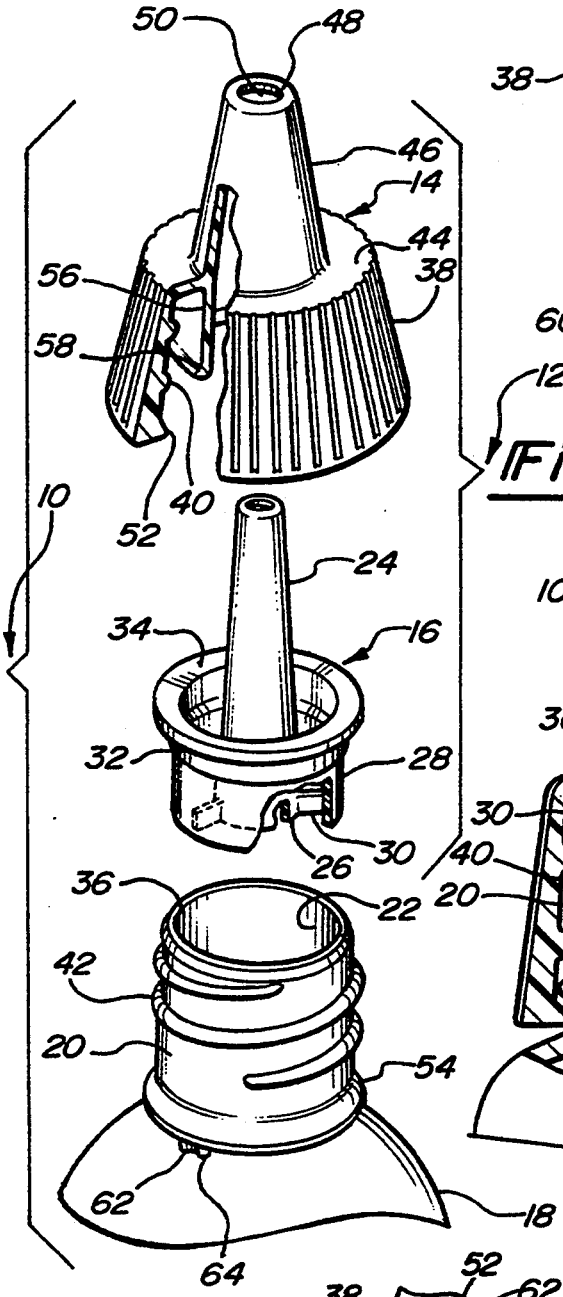
FIG. 1 is an exploded perspective view of the container closure package showing the relationship of the fitment with the cap and the container neck.
Figure 2:
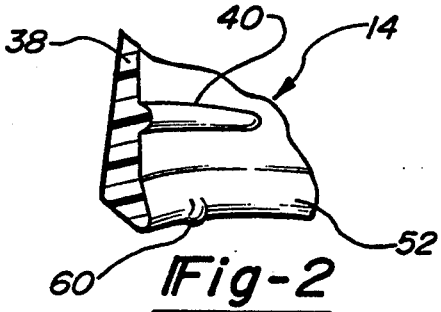
FIG. 2 is a fragmentary perspective view of the bottom of the cap skirt showing the locking and sensing lug extending upwardly from and inwardly directed bead.

Referring to FIG. 1, the dispensing closure-container package 10 of the invention is shown as including a closure 12 having a cap 14 and a fitment 16 which is applied to the neck 20 of container 18 to control dispensing through the opening 22 in the container neck.

The closure fitment 36 includes a generally cylindrical centrally located plug 24 which preferably tapers inwardly as it extends outwardly from its lower end 26. Fitment plug member 24 is joined to a concentrically located outer skirt 28 at its lower end 26 by radial ribs 30. The outer skirt 28 has a sealing ring 32 and an outwardly extending flange 34 at its top. When the fitment 16 is inserted into the container neck opening 22, the sealing ring 32 seats in the container neck opening 22 and the flange 34 seats against the container neck lip 36. There is preferably an interference fit between the sealing ring 32 and the container neck opening 22 to form a permanent seal.

The closure cap 14 has an outer skirt 38 carrying internal thread 40 which engages container neck thread 42. The cap 14 has an intermediate horizontal ledge 44 and an upwardly extending dispensing nozzle 46 having a top 48 with a centrally located dispensing orifice 50.

The cap skirt 38 has an inwardly directed bead 52 which engages and snaps over container neck flange 54 located below container neck threads 42.

The closure 12 is normally assembled as a unit with the fitment 16 being held in the cap 14 by frictional contact of the fitment plug 24 with dispensing orifice 50. The closure including the cap 14 and fitment 16 is assembled to the container neck in a single caping operation resulting in retention of the fitment 16 in the container neck 20 by the interference fit between sealing ring 32 and the container opening 22. The cap 14 is retained on the container neck 20 by the coaction of the inwardly directed cap skirt bead 52 with the outwardly directed container neck flange 54.

Figure 6:
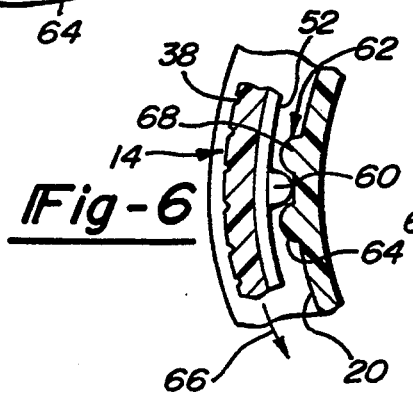
FIG. 6 is a partial sectional view taken along line 6—6 of FIG. 4.
Figure 5:
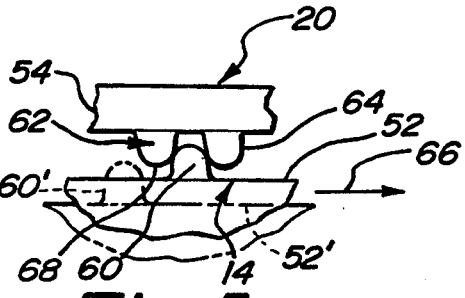
FIG. 5 is a partial sectional view along line 5—5 of FIG. 4.
Figure 4:
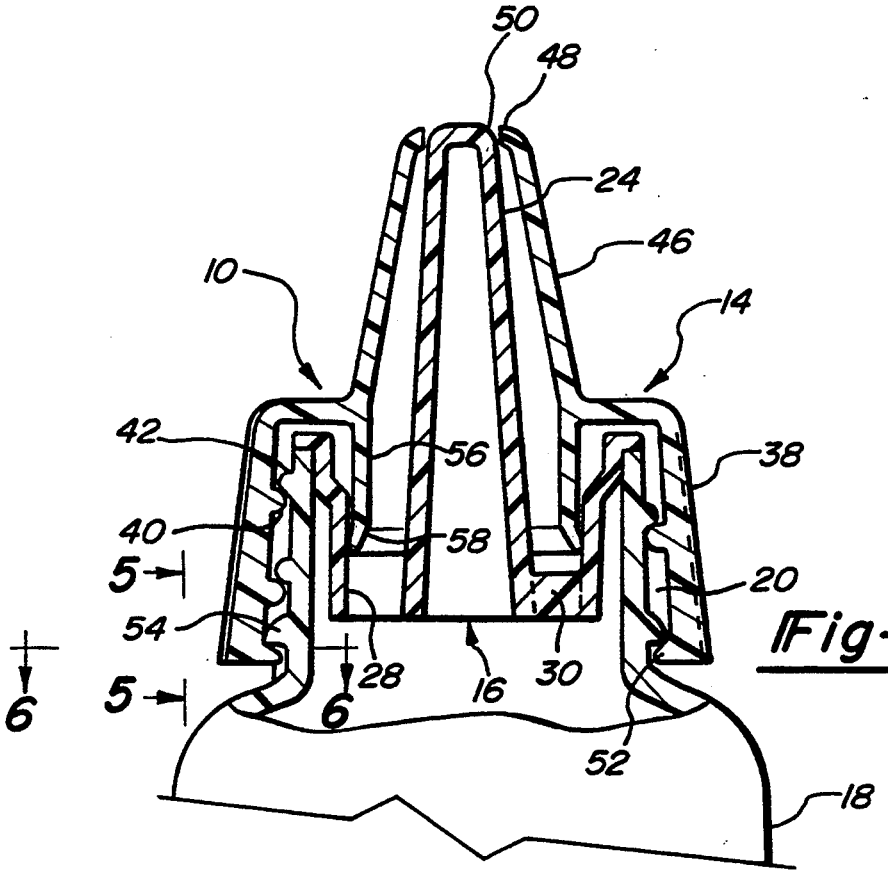
FIG. 4 is an elevational view in section similar to FIG. 3 showing the closure in its open, dispensing position.

Cap inner skirt 56 is formed intermediate dispensing orifice 50 and outer cap skirt 38 by a downward extension of the dispensing nozzle 46. The inner cap skirt 56 extends outwardly at its free end 58 and it is in continuous sealing contact with the outer skirt 28 of fitment 16 as best seen in FIGS. 3 and 6.

Figure 3:
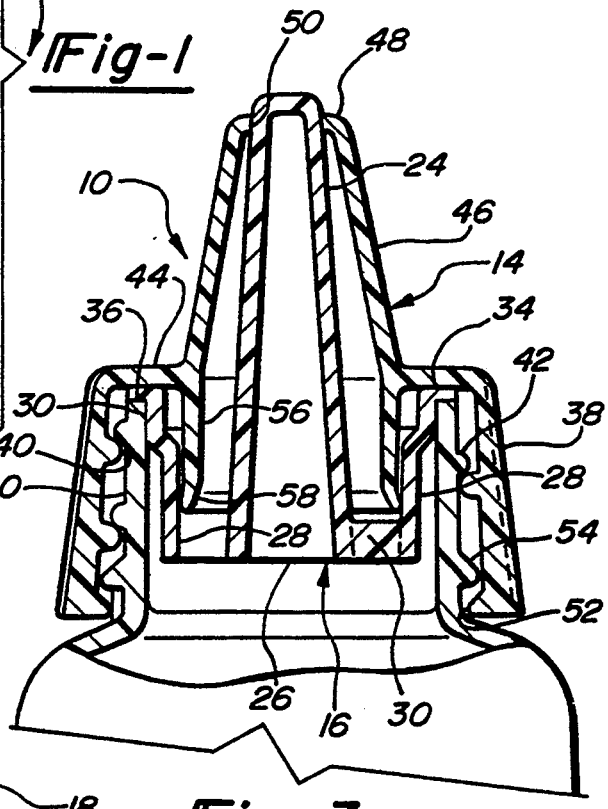
FIG. 3 is an elevational view in section showing the closure in its closed position on the container neck.

As the cap 14 is threaded in a clockwise direction onto the container 20, the plug 24 will seal the dispensing orifice 50 in the closed position of the cap as seen in FIG. 3. As the cap is unthreaded in a counterclockwise direction, the dispensing nozzle 46 will move upward with respect to the fitment plug 24 opening the orifice 50 for dispensing as seen in FIG. 6. In the prior art structure, since the cap 14 is retained on the container neck 12 by the interference of container skirt bead 52 with the container neck flange 54, over zealous unthreading of the cap 14 can result in removal of the cap from the container neck by snapping the container skirt bead 52 over the container neck flange 54. Likewise, the user of the prior art closure does not have a feedback feel of when the cap is in its dispensing open position.

The feature of sensing the approach of the open dispensing position of the cap 14 is provided in the present invention by lug 60 extending upwardly from the inwardly directed flange 52 on the cap skirt 38 which, in the embodiment of FIGS. 1–6, acts in cooperation with a pair of downwardly extending projections 62 and 64 on the container neck flange 54. As the cap is being turned in an unthreading direction indicated by the arrow 66 in FIGS. 5 and 6, the cap lug 60 will first come into contact with the container neck projection 62, and the lug 60 passing over the rounded end 66 of the projection 62 allows the user to sense the approach of the open position of the cap. This approaching position is seen at 60' in FIG. 5. The user will feel the increased resistance and hear a click when the plug snaps over the first projection. When the cap lug passes over the first projection 62, it comes into contact with the second axially extending projection 64 which prevents any further rotation of the cap with respect to the container neck. This acts as a positive stop or lock preventing the cap from being removed from the container neck. The rounded end 66 of the projection 62 allows the lug to pass over the projection 62 both in the opening direction and in the closing direction.

Figure 7:
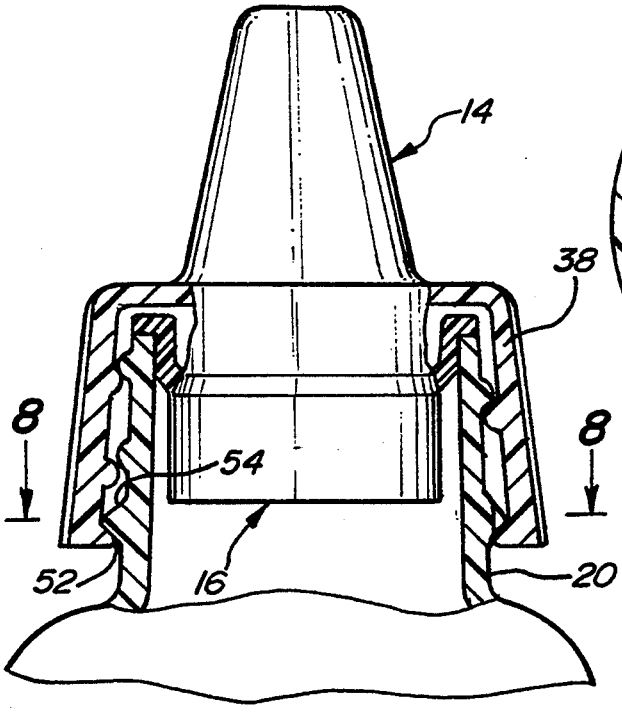
FIG. 7 is an elevational view in partial section of another embodiment of the invention showing the closure in its open, dispensing position.
Figure 8:
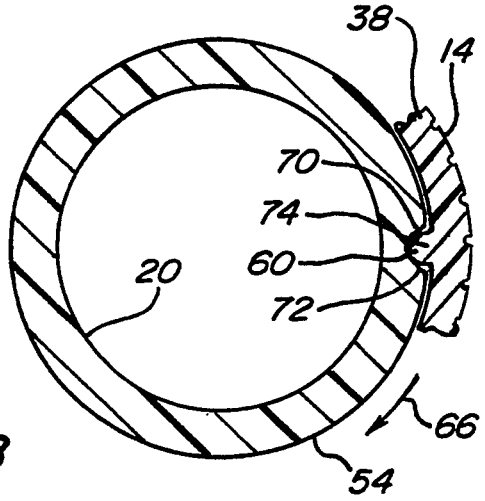
FIG. 8 is a sectional view along line 8—8 of FIG. 7.

In the embodiment of FIGS. 7 and 8, the container neck flange 54 is discontinuous, having a circumferential gap at 74. The lug 60 on the cap skirt 38 acts in cooperation with axially extending walls 70 and 72 at adjacent ends of the container neck flange 54 at gap 74. As the cap is being turned in an unthreading direction, indicated by the arrow 66 in FIG. 8, the cap lug 60 will pass over the wall 70 dropping into the gap 74, and the user will feel a decrease in resistance and hear a click. Upon continued rotation the cap lug 60 will contact the second axially extending wall 72 which prevents any further rotation of the cap.

I claim:

1. In a dispensing closure-container package comprising, in combination:

a container having a cylindrical neck with an external thread and an outwardly extending flange below said thread;

a fitment having a centrally located cylindrical plug member and a concentric outer skirt sealingly received on said container neck;

a cap having a top with a dispensing orifice therein and a cylindrical outer skirt with an internal thread engaging said external neck thread allowing axial movement of said cap along said neck, engaging said plug member with said dispensing orifice in a closed position and disengaging said dispensing orifice in an open dispensing position;

said cylindrical cap outer skirt having an inwardly directed bead below said internal thread which snaps over said outwardly extending flange on the container neck when said cap is initially applied to said container neck;

the improvement comprising means for sensing the approach of said open dispensing position and for locking said cap in said position, said means including:

a pair of circumferentially spaced axially extending walls on said container flange; and a lug extending axially upward from said inwardly directed cap skirt bead;

wherein as said cap is being turned in an opening direction, said lug will pass over a first one of said pair of walls allowing the user to feel the approach of said open position, and, as said cap is turned further, said lug will abut against a second one of said pair of walls to stop any further rotation of said cap.

2. The closure-container package according to claim 1 wherein said axially extending walls include spaced projections extending axially downward from said container flange so that as said cap is being turned in an opening direction, said lug will jump over a first one of said pair of projections allowing the user to feel the approach of said open position, and, as said cap is turned further, said lug will abut against the second one of said pair of projections to stop any further rotation of said cap.

3. The closure-container package according to claim 2 wherein the first one of said pair of space projections has a rounded free end to facilitate movement of said lug over said first one of said projections when the cap is being turned in an opening direction and in a closing direction.

4. The closure-container package according to claim 1 wherein said container neck flange is discontinuous at a point creating said circumferentially spaced axially extending walls at adjacent ends of said flange.

5. A dispensing closure for attachment to a container having a cylindrical neck with an external thread and an outwardly extending flange below said thread, said closure comprising, in combination:

a fitment having a centrally located cylindrical plug member and a concentric outer skirt sealingly received on said container neck;

a cap having a top with a centrally located dispensing orifice therein and a cylindrical outer skirt with an internal thread engaging said external thread allowing axial movement of said cap along said neck, engaging said plug member with said dispensing orifice in a closed position and disengaging said dispensing orifice in an open dispensing position;

said cylindrical cap outer skirt having an inwardly directed bead below said internal thread which snaps over said outwardly extending flange on the container neck when said cap is initially applied to said container neck;

said cap further including sensing and locking means for sensing the approach of said open dispensing position and for locking said cap in said position, said sensing and locking means including a lug axially extending upward from said inwardly dissected cap bead;

wherein as said cap is being turned in an opening direction, said lug will pass over a first one of a pair of circumferentially spaced axially extending walls on said container neck flange allowing the user to feel the approach of said open position, and, as said cap is turned further, said lug will abut against a second one of said pair of walls to stop further rotation of said cap.

6. The dispensing closure according to claim 5 wherein said cap has an inner skirt concentrically located between said outer skirt and said dispensing orifice, and, as said cap is axially moved along said container neck, a sealing relationship will be maintained between said cap inner skirt and said fitment outer skirt

* * * * *